US005903182A

United States Patent [19]

Jordan

[11] Patent Number: 5,903,182

[45] Date of Patent: May 11, 1999

[54] METHOD AND SYSTEM FOR PROVIDING A REGULATED CORE VOLTAGE TO A PROCESSOR WITHIN A COMPUTER SYSTEM

[75] Inventor: James Douglas Jordan, Round Rock, Tex.

[73] Assignee: International Business Machines Corporation, Armonk, N.Y.

[21] Appl. No.: 08/799,140

[22] Filed: Feb. 13, 1997

[51] Int. Cl.[6] ..... G05F 1/10

[52] U.S. Cl. ..... 327/540; 327/538; 327/535; 327/331; 323/233; 323/293

[58] Field of Search ..... 327/538, 540, 327/541, 331, 535, 545; 323/233, 293

[56] References Cited

U.S. PATENT DOCUMENTS 5,163,025 11/1992 Chamberlain ..... 365/226

*Primary Examiner*—Kenneth B. Wells
*Assistant Examiner*—Minh Nguyen
*Attorney, Agent, or Firm*—Volel Emile; Antony P. Ng; Andrew J. Dillon

[57] ABSTRACT

A method for providing a regulated core voltage to a processor within a computer system is disclosed. In accordance with a method and system of the present invention, a power supply is provided for a processor that includes multiple core transistors and multiple I/O transistors. An input voltage is supplied to a first power input of the processor for powering the I/O transistors within the processor. This input voltage is also supplied to a second power input of the processor for powering the core transistors within the processor via a voltage regulator and a resistor, with the voltage regulator and the resistor connected in parallel, such that the voltage drop across said voltage regulator can be reduced.

12 Claims, 4 Drawing Sheets

METHOD AND SYSTEM FOR PROVIDING A REGULATED CORE VOLTAGE TO A PROCESSOR WITHIN A COMPUTER SYSTEM

BACKGROUND OF THE INVENTION

1. Technical Field

The present invention relates to a method and system for supplying power to a processor in general and, in particular, to a method and system for providing a voltage to a processor within a computer system. Still more particularly, the present invention relates to a method and system for providing a tightly regulated core voltage to a processor within a computer system.

2. Description of the Prior Art

Many high-performance processors require two voltage levels for normal operations, one voltage level for operating processor I/O transistors and the other voltage level for operating processor core transistors. Typically, the operating voltage for the processor I/O transistors is directly supplied by a standard 3.3V power supply having a regulation of about ±5%. This results in a voltage range of as low as 3.135V and as high as 3.465V for the processor I/O transistors. The voltage for operating the processor core transistors, known as core voltage, may require a voltage of 2.7V with a tolerance of ±100 mV or better. Typically, this core voltage is also provided by the standard 3.3V power supply via a voltage regulator.

In order for a voltage regulator to function correctly, there needs to be at least a 0.5V difference between the input voltage and the output voltage of the voltage regulator. This 0.5V voltage differential is known as the "headroom" of the voltage regulator. In the meantime, the continued demand of processor performance levels to higher frequencies within a specific technology often requires a higher core voltage. As the core voltage goes up, there may not be enough "headroom" for the voltage regulator to function properly. One obvious solution to this problem would be to upgrade the power supply from a standard 3.3V to a standard 5.0V. But, needless to say, one of the many disadvantages of operating a 3.3V processor under a standard 5.0V power supply is that excessive electrical power is required to be dropped across the voltage regulator, resulting in power being wasted. Further, the wasted power, usually in the form of heat, also needs to be properly dissipated from the chassis of a computer system in which the processor is installed.

In addition, during the powering-up of some processors, the voltage difference between the processor I/O transistors' voltage and the core voltage must be maintained within a certain range of each other. If this voltage differential becomes too large, some transistors within the processor may get damaged or, at a minimum, the life of the processor will be unnecessarily shortened. In order to maintain compatibility with the standard 3.3V technology, it would be desirable to provide an improved method and system to provide a tightly regulated processor core voltage within a computer system such that a standard 3.3V power supply can still be utilized for the computer system having a processor with a higher core voltage demand.

SUMMARY OF THE INVENTION

In view of the foregoing, it is therefore an object of the present invention to provide an improved method and system for supplying power to a processor.

It is another object of the present invention to provide an improved method and system for providing a voltage to a processor within a computer system.

It is yet another object of the present invention to provide an improved method and system for providing a tightly regulated core voltage to a processor within a computer system.

In accordance with a method and system of the present invention a power supply is provided for a processor that includes multiple core transistors and multiple I/O transistors. An input voltage is supplied to a first power input of the processor for powering the I/O transistors within the processor. This input voltage is also supplied to a second power input of the processor for powering the core transistors within the processor via a voltage regulator and a resistor, with the voltage regulator and the resistor connected in parallel, such that the voltage drop across the voltage regulator can be reduced.

All objects, features, and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

The present invention is applicable to a variety of computers having a high-performance processor with a dual-power input requirement. For the purpose of illustration, a preferred embodiment of the present invention, as described below, is implemented on a personal computer having a PowerPC™ processor, both manufactured by the International Business Machines Corporation.

Figure 1:
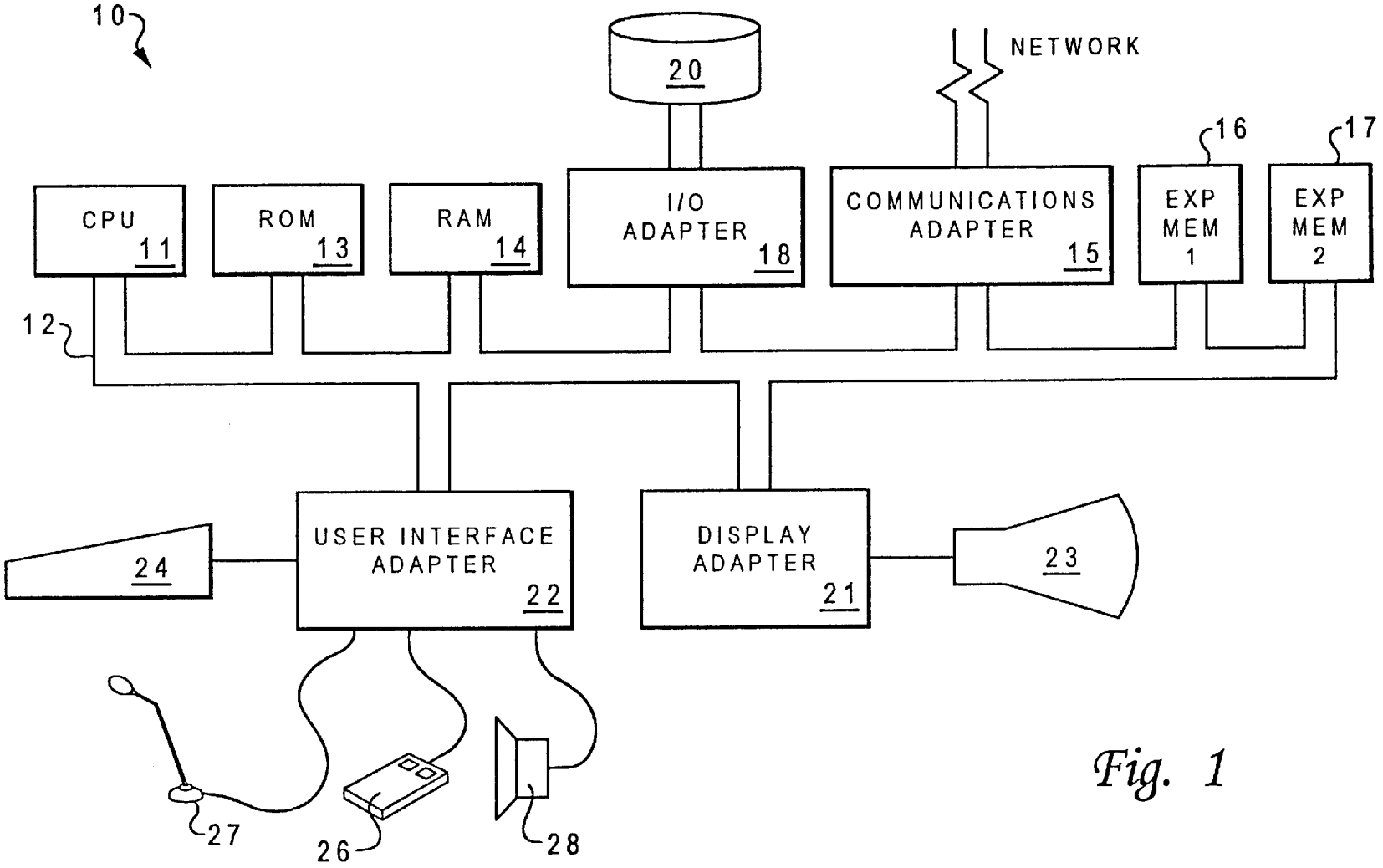
FIG. 1 is a block diagram of a typical computer system that may be utilized in conjunction with a preferred embodiment of the present invention.

Referring now to the drawings and in particular to FIG. 1, there is depicted a diagram of a typical computer system 10 which may be utilized in conjunction with a preferred embodiment of the present invention. A central processing unit (CPU) 11, such as a PowerPC™ processor, is interconnected to various other components via system bus 12. Read-only memory (ROM) 13, connecting to CPU 11 via system bus 12, includes a basic input/output system (BIOS) software that controls certain basic computer functions. Random-access memory (RAM) 14, I/O adapter 18, and communications adapter 15 are also interconnected to system bus 12. Expanded memory 16 and expanded memory 17 may be added to computer system 10, and are shown to be interconnected to system bus 12.

Generally, expanded memories 16 and 17 are adapter cards that include multiple single in-line memory modules (SIMMs), along with corresponding registers capable of being written to by an appropriate device driver. I/O adapter 18 may be a Small Computer System Interface (SCSI) adapter that communicates with a disk storage device 20. Communications adapter 15 interconnects system bus 12 with an outside network, enabling computer system 10 to communicate with other such systems. In addition, input/output devices are connected to system bus 12 via user interface adapter 22 and display adapter 21. Keyboard 24, microphone 27, mouse 26, and speaker 28 are all interconnected to system bus 12 via user interface adapter 22. Display monitor 23 is connected to system bus 12 via display adapter 21. In this manner, a user is capable of inputting to computer system 10 through keyboard 24, microphone 27, or mouse 26 while receiving output from computer system 10 via speaker 28 and display monitor 23.

Figure 2:
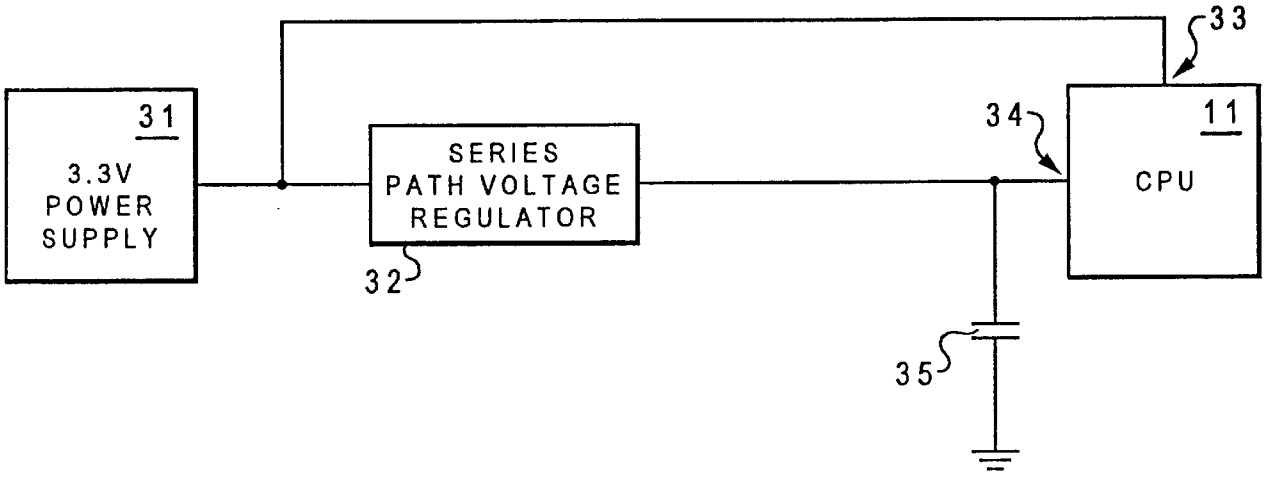
Fig. 2 Prior Art
FIG. 2 is a block diagram of a power configuration under the prior art.

With reference now to FIG. 2, there is depicted a block diagram of a power configuration for CPU 11 under the prior art. As shown, a standard 3.3V power supply 31 is utilized to supply power to I/O transistors and core transistors within CPU 11. The I/0 transistors are powered by the input voltage from a voltage input 33 while the core transistors are powered by the input voltage from a voltage input 34. Voltage input 33 receives its operating voltage (~3.3V) directly from power supply 31. Voltage input 34 receives its operating voltage (~2.7V) from power supply 31 via a low-drop-type FET voltage regulator 32. Capacitor 35 is a de-coupling capacitor for CPU 11. In order for voltage regulator 32 to function properly, typically, there needs to be at least 0.5V differential between the input and the output of voltage regulator 32. But, as the demand for a higher core voltage keeps increasing (i.e., operating voltage for voltage input 34 is approaching but not equal 3.3V), there is not enough "headroom" for voltage regulator 32 to operate properly. A power supply capable of providing a higher voltage such as a standard 5.0V power supply can certainly be utilized instead of the standard 3.3V power supply. In most applications, however, a 5.0V power supply may require too much a voltage drop across voltage regulator 32, resulting in large amount of wasted power.

The present invention provides an economical solution to the prevailing problem. The solution is to utilize a current-injection resistor in conjunction with voltage regulator 32. This solution is also applicable to a power configuration in which a reduced-size DC-to-DC convertor having a current injection assistance is utilized instead of a voltage regulator, as will be shown infra.

Figure 3:
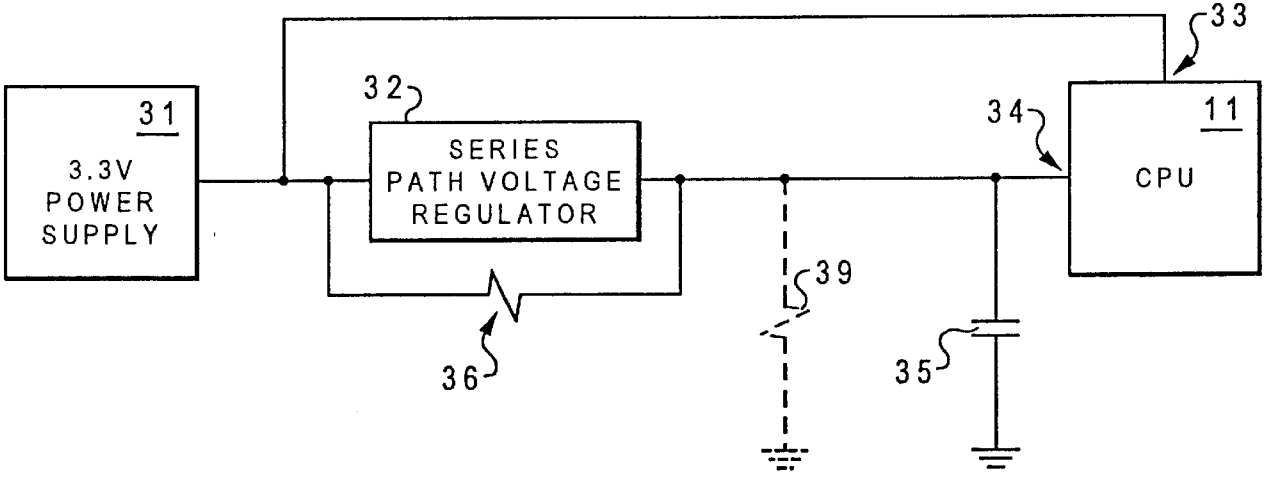
FIG. 3 is a block diagram of a power configuration in accordance with a preferred embodiment of the present invention.

Referring now to FIG. 3, there is illustrated a block diagram of a power configuration for CPU 11 in accordance with a preferred embodiment of the present invention. Similar to FIG. 2, voltage input 33 of CPU 11 is directly powered by a standard 3.3V power supply 31, while voltage input 34 is powered by power supply 31 via a series path voltage regulator 32. In this power configuration, however, a current-injection resistor 36 is added in parallel with voltage regulator 32 between power supply 31 and voltage input 34.

Figure 4:
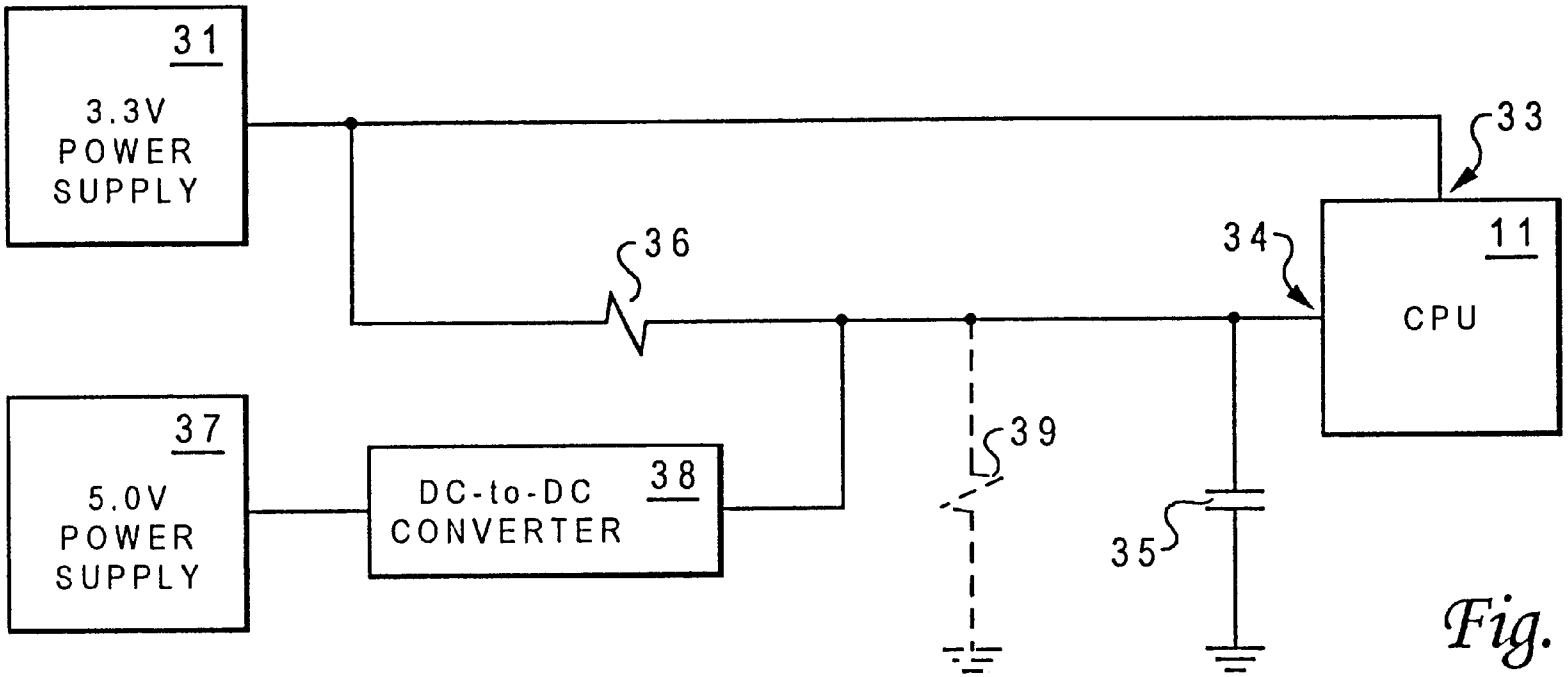
FIG. 4 is a block diagram of a power configuration in accordance with an alternative embodiment of the present invention.

With reference now to FIG. 4, there is depicted a block diagram of a power configuration for CPU 11 in accordance with an alternative embodiment of the present invention. A reduced-size DC-to-DC converter 38 is utilized instead of a voltage regulator 32 for supplying power to voltage input 34 from a standard 5.0V power supply 37. In addition, a standard 3.3V power supply 31 is utilized to provide power to both voltage input 33 and voltage input 34. Resistor 36, connected between power supply 31 and voltage input 34, serves the same function as in the powering configuration of FIG. 3.

In both depicted embodiments of the present invention, resistor 36 creates a low-resistance current-injection path such that the CPU load through resistor 36 is lowered. Testing shows that the lower the voltage regulator current is, the lower the minimum dropout voltage. In the case of a DC-to-DC converter, current injection allows a reduction in current-carrying capacity required by internal DC-to-DC components. This solution also takes into consideration the fact that in a low-power mode, such as a sleep or hibernation mode, when CPU 11 draws very little current, it is acceptable for the core voltage to approach the I/O transistor voltage in magnitude. In cases when this is not acceptable, a load resistor 39 (shown in phantom lines in FIG. 3 and FIG. 4) can be utilized as a bleed resistor to ensure a minimum load through voltage regulator 32 or DC-to-DC converter 38. Note that, with the powering configuration as shown in FIG. 4, both load resistor 39 and decoupling capacitor 35 can be incorporated within DC-to-DC converter 38.

The resistance value of current-injection resistor 36 is governed by the minimum load of CPU 11 during operation and the input voltage range as well as the output voltage range of voltage regulator 32. In addition, the possibility of current-injection resistor 36 stealing all the current from voltage regulator 32 during a low-power mode must be considered. This is because a low-power mode in some processors may prevent the usage of current-injection resistor 36 as a solution. However, if the core voltage only increases to some value that is less than the I/O transistor voltage during the low-power mode, then this current-injection resistor 36 may be acceptable because the total power is still very low. As a preferred embodiment of the present invention, the minimum-resistance value for current-injection resistor 36, R, can be calculated by $$R = \frac{V_{I/O\,DC\,\max} - V_{core\,DC\,\min}}{I_{CPU\,operating\,\min}}$$

where:

$V_{I/O\ DC\ max}$=maximum DC voltage value for I/O transistors $V_{core\ DC\ min}$=minimum voltage regulator DC voltage value to core transistors $I_{CPU\ operating\ min}$=minimum current value for CPU during normal operation Also, current-injection resistor 36 that is parallel with voltage regulator 32 should improve the output transient response to a very fast load transition as well. If a very fast load transient causes the output of voltage regulator 32 to drop 100 mV, this would cause an instantaneous increase of 0.5A to go though current-injection resistor 36 of, for example, 0.2Ω. Furthermore, current-injection resistor 36 should have as little inductance as possible. For optimal power and cost, several surface-mount resistors can be connected in parallel as current-injection resistors.

Figure 5A:
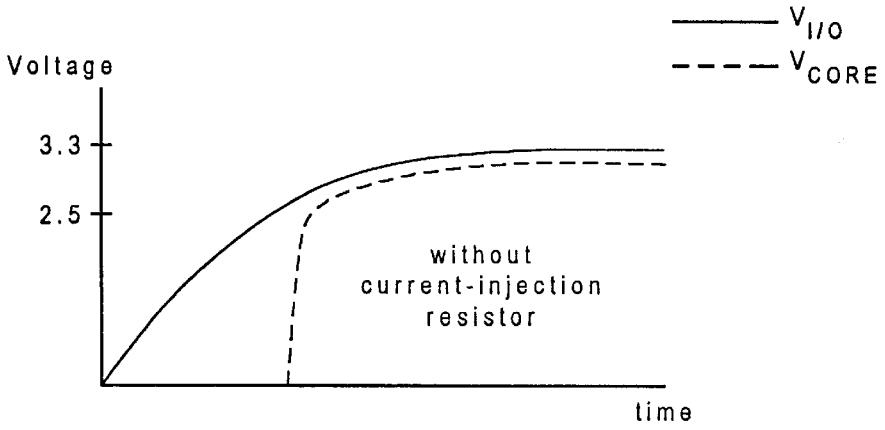
FIGS. 5*a*, 5*b*, and 5*c* are several graphs depicting the difference in core voltage with respect to I/O transistor voltage during power-up under various power configurations.
Figure 5B:
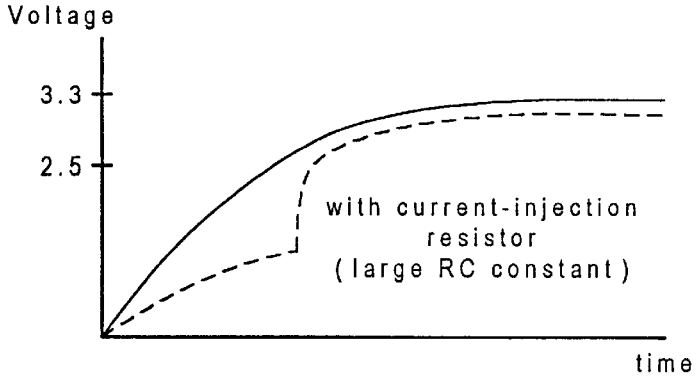
Figure 5C:
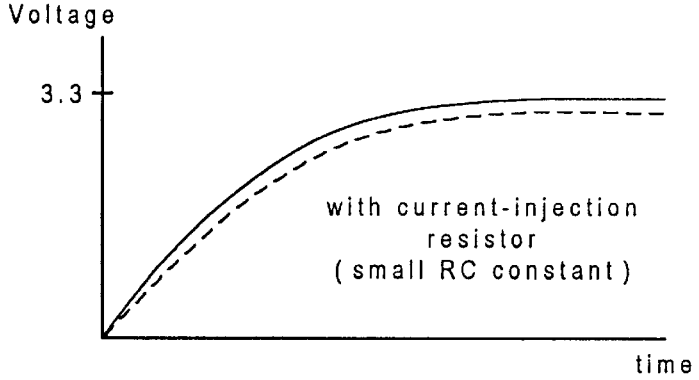

Referring now to FIGS. 5*a*, 5*b*, and 5*c*, there are illustrated several graphs depicting the difference in core voltage, $V_{core}$, with respect to I/O transistor voltage, $V_{I/O}$, during power-up under various powering configurations. FIG. 5*a* shows the $V_{core}$ and $V_{I/O}$ curves during power-up under a powering configuration without current-injection resistor 36. FIGS. 5*b* and 5*c* show the $V_{core}$ and $V_{I/O}$ curves during power-up under a powering configuration with current-injection resistor 36. The difference between FIG. 5*b* and FIG. 5*c* is that the RC time constant (from current-injection resistor 36 and capacitor 35) in FIG. 5*b* is higher than that of FIG. 5*c*. The initial ramp rate for $V_{core}$ is a function of the capacitance in capacitor 35 on $V_{core}$ and current-injection resistor 36. Less capacitance and lower current-injection resistance allow $V_{core}$ to track $V_{I/O}$ better.

As has been described, the present invention provides an improved method and system for providing a tightly regulated core voltage to a processor within a computer system. There are several advantages to the present invention. First, the CPU load that either a series-pass voltage regulator or a DC-to-DC converter must handle is reduced to slightly more than the dynamic load portion of the CPU normal operating current. Most of the normal operating mode steady state current can be supplied through the current-injection resistor. Second, power is transferred from the core voltage regulating device (i.e., voltage regulator) to the current-injection resistor. This reduces the maximum load-operating range requirements of the series-pass voltage regulator, allowing better temperature control, less heat-sinking requirement, and reduced component size. Third, the bandwidth to fast load changes is improved. The current furnished through the current-injection resistor is a function of the instantaneous voltage drop across the current-injection resistor. A very fast drop in the core voltage causes a greater $\Delta V$ across the current-injection resistor and an instantaneously higher current through the current-injection resistor without any response from the series-pass voltage regulator or the DC-to-DC converter. Fourth, when utilized with a low-drop voltage regulator operating from 3.3V in a shunt mode, the current-injection technique offers a very cost competitive solution to providing a core voltage of 150 mV to 250 mV below the I/O transistor voltage. The actual dropout voltage is a function of the voltage regulator and the magnitude of the dynamic portion of the CPU load during normal operation. Fifth, the current-injection technique can be safely implemented in some processors having low-power modes, where holding a tight core voltage regulation is not critical. Sixth, the current-injection technique can be utilized to control voltage separation between core voltage and I/O transistor voltage during power-up and power-down. Load resistor 39 (in FIG. 3 and FIG. 4) can be utilized to supplement minimum-load power modes to prevent core voltage from getting too high, damaging the processor's internal transistors or shortening their lives. Seven, very low dropout operation off the I/O transistor voltage of 3.3V produces high efficiencies with little power lost through heat.

On the contrary, the current-injection technique also has a few disadvantages. First, extra care must be taken to account for low-power modes of processor operation in order to ensure that a core voltage approaching the I/O transistor voltage during a low-power mode will not damage the processor; otherwise, a bleed resistor is utilized to prevent voltage violations in these low-power modes. Second, if a bleed resistor is required, the bleed resistor will increase the load and power lost during normal operation unless it is a switched bleed resistor. Having to utilize a bleed resistor also limits the amount of current-injection benefit available. However, a bleed resistor still provides certain voltage-tracking benefits during power-up and power-down of the computer system. Finally, utilizing injection voltages other than 3.3V is possible, but the safety in utilizing an injection voltage more than 10% above the core voltage must be factored into the design of the computer system.

While the invention has been particularly shown and described with reference to a preferred embodiment, it will be understood by those skilled in the art that various changes in form and detail may be made therein without departing from the spirit and scope of the invention.

What is claimed is:

1. A method for providing input voltages to a processor within a computer system, said processor includes a plurality of core transistors and a plurality of I/O transistors, said method comprising the steps of:

supplying an input voltage to a first power input of said processor for powering said plurality of I/O transistors within said processor; and supplying said input voltage to a second power input of said processor for powering said plurality of core transistors within said processor via a voltage regulator and a resistor, wherein said voltage regulator and said resistor are connected in parallel, wherein a sum of current entering said voltage regulator and said resistor is equal to a sum of current exiting said voltage regulator and said resistor, such that the voltage drop across said voltage regulator can be reduced.

2. The method according to claim 1, wherein said step of supplying an input voltage further includes a step of supplying an input voltage of approximately 3.3V.

3. The method according to claim 1, wherein said step of supplying said input voltage via a resistor further includes a step of supplying said input voltage via a resistor having a value governed by a minimum load of said processor during operation and an input range as well as an output range of said voltage regulator.

4. The method according to claim 1, wherein said method further includes a step of connecting a bleed resistor between said second power input and ground.

5. A method for providing input voltages to a processor within a computer system, said processor includes a plurality of core transistors and a plurality of I/O transistors, said method comprising the steps of:

supplying a first input voltage to a first power input of said processor for powering said plurality of I/O transistors within said processor, and said first input voltage to a second power input via a resistor; and supplying a second input voltage to a second power input of said processor via a DC-to-DC converter for powering said plurality of core transistors within said processor, such that the voltage drop across said voltage regulator can be reduced.

6. The method according to claim 5, wherein said supplying a first input voltage step further includes a step of supplying a first input voltage of approximately 3.3V.

7. The method according to claim 5, wherein said supplying a second input voltage step further includes a step of supplying a second input voltage of approximately 5.0V.

8. The method according to claim 5, wherein said step of supplying said input voltage via a resistor further includes a step of supplying said input voltage via a resistor having a value governed by a minimum load of said processor during operation and an input range as well as an output range of said voltage regulator.

9. The method according to claim 5, wherein said method further includes a step of connecting a bleed resistor between said second power input and ground.

10. A powering configuration to a computer system, wherein said computer system includes a processor, wherein said processor includes a plurality of core transistors and a plurality of I/O transistors, said power configuration comprising:

a voltage regulator;

a resistor connected in parallel with said voltage regulator, wherein a sum of current entering said voltage regulator and said resistor is equal to a sum of current exiting said voltage regulator and said resistor,; and a power supply connected to a first power input of said processor for powering said plurality of I/O transistors, wherein said power supply further connected to a second power input of said processor via said voltage regulator and said resister for powering said plurality of core transistors such that the voltage drop across said voltage regulator can be reduced.

11. The power configuration to a computer system according to claim 10, wherein said power supply is a standard 3.3V power supply.

12. The power configuration to a computer system according to claim 10, wherein a value of said resistor can be calculated by:

$$R = \frac{V_{I/O\,DC\,\max} - V_{core\,DC\,\min}}{I_{CPU\,operating\,\min}}$$

where:

R=minimum value of said resistor $V_{I/O\ DC\ max}$=maximum DC voltage value for said I/O transistors $V_{core\ DC\ min}$=minimum voltage regulator DC voltage value to said core transistors $I_{CPU\ operating\ min}$=minimum current value for said processor during normal operation.

* * * * *